United States Patent [19]

Yamada

[11] Patent Number: 4,811,468

[45] Date of Patent: Mar. 14, 1989

[54] HOOK ELEMENT FOR SURFACE FASTENERS

[75] Inventor: Yasuo Yamada, Kurobe, Japan

[73] Assignee: Yoshida Kogyo K. K., Tokyo, Japan

[21] Appl. No.: 125,177

[22] Filed: Nov. 25, 1987

[30] Foreign Application Priority Data

Nov. 26, 1986 [JP] Japan ..... 61-180555

[51] Int. Cl.[4] ..... A44B 18/00

[52] U.S. Cl. ..... 24/442; 24/445

[58] Field of Search ..... 24/442, 443, 444, 445, 24/446, 447, 381, 389, 394; 425/381.2; 264/78

[56] References Cited

U.S. PATENT DOCUMENTS

| | | | |
|---|---|---|---|
| 2,572,719 | 10/1951 | Ginell et al. | 264/78 |
| 3,015,989 | 1/1962 | Delangre et al. | 264/78 |
| 3,439,077 | 4/1969 | Fischler | 264/78 |
| 3,783,476 | 1/1974 | Frohlich | 24/394 |
| 3,921,258 | 11/1975 | Brumlik | 24/447 |
| 4,169,303 | 10/1979 | Lemelson | 24/446 |
| 4,330,907 | 5/1982 | Ochiai | 24/445 |

FOREIGN PATENT DOCUMENTS

| | | | |
|---|---|---|---|
| 0117637 | 7/1982 | Japan | 264/78 |
| 3326086 | 8/1984 | Japan | 24/442 |

*Primary Examiner*—Victor N. Sakran

*Attorney, Agent, or Firm*—Hill, Van Santen, Steadman & Simpson

[57] ABSTRACT

A hook or male element for surface fasteners which is made of a thermoplastic monofilamentary material and which is provided with a coarse surface finish having a multiplicity of alternate minute recesses and ridges, giving rise in its frictional force and ensuring firm, stable engagement with loop or female elements. Having the minute recesses throughout its surface, this hook element can be dyed homogeneously or distinctly at the user's request.

2 Claims, 1 Drawing Sheet

HOOK ELEMENT FOR SURFACE FASTENERS

This application is related to my copending application, U.S. Ser. No. 125,177.

BACKGROUND OF THE INVENTION

1. Field of the Invention

This invention relates generally to hook-and-loop or surface fasteners and particularly to hook elements therefor.

2. Description of the Prior Art

Many hook-and-loop fasteners have been proposed in the art for use on a variety of articles such as sphysmomanometer bands, wrist watch bands, diapers, bags, clothings, sporting goods and the like. Conventional hook-and-loop fasteners comprise hooks or male elements on one support tape engageable with corresponding loops or female elements on the other tape, the hooks being plastic monofilaments having a round cross section and smooth or refined surface characteristics. Because of these physical characteristics, the hook elements are held in coupling engagement with their meting loop elements normally only by virtue of their elastic action and hence are susceptible to separation while in use. Furthermore because of its surface being highly water-repellant, the monofilamentary material is difficult to dye homogeneously.

SUMMARY OF THE INVENTION

With the foregoing drawbacks of the prior art in view, the present invention seeks to provide a hook or male element for surface fasteners which is capable of engagement with its female counterpart with greater bonding strength.

It is another object of the invention to provide a hook element for surface fasteners which can be homogeneously and distinctly dyed.

Briefly stated, the hook element of the invention is provided with a coarse surface finish having a multiplicity of alternate minute recesses and ridges which increase its frictional force and ensure firm, stable engagement with loop elements.

The above and other objects and features of the invention will be better understood from the following description taken in connection with the accompanying drawings which illustrate by way of example a preferred embodiment of the invention.

DETAILED DESCRIPTION OF THE INVENTION

Figure 1:
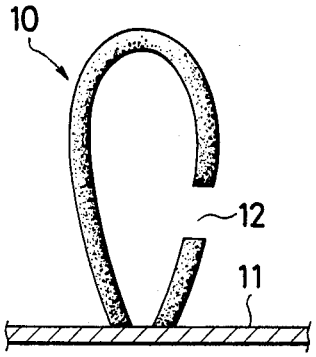
FIG. 1 is a front elevational view of a hook element on a support tape according to the invention.
Figure 2:
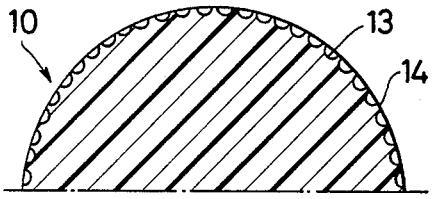
FIG. 2 is a cross-sectional view, on enlarged scale of a portion of the hook element.
Figure 3:
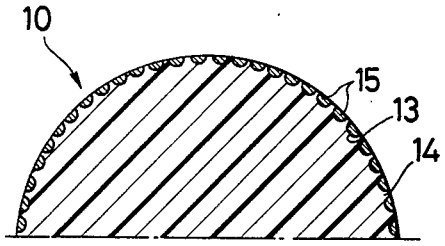
FIG. 3 is a view similar to FIG. 2, but showing the hook element dyed.

Referring to FIG. 1, there is shown a preferred form of a hook or male element 10 generally circular in cross section which is supported on a substrate such as a tape 11 and which has a slit 12 through which the hook 10 is engageable with its mating loop or female element (not shown), in a manner well known in the art. The hook element 10 of FIG. 1 is made of a suitable thermoplastic filamentary material and provided with a coarse surface finish having a multiplicity of minute recesses 13 alternating with minute ridges 14 as better shown in FIG. 2.

The fine coarseness of the hook element surface which may be provided by means of sand blast or shot blast, creates increased frictional coefficient whereby the hook elements 10 can be engaged with their loop counterparts with greater bonding strength.

The recesses 13 in particular of the hook element 10 can be advantageously made use of in retaining a dye solution 15 applied for example by a pad steamer, so that the starting filamentary material can be dyed homogeneously and distinctly at the user's request.

What is claimed is:

1. A hook element for surface fasteners which is made of a thermoplastic monofilamentary material and which is provided with a coarse surface finish having a multiplicity of alternate minute recesses and ridges distributed over the entire peripheral surface of said hook element.

2. A hook element for surface fasteners according to claim 1, wherein said minite recesses are filled with a dye.

* * * * *